US006085423A

United States Patent [19]

Marifone

[11] Patent Number: 6,085,423

[45] Date of Patent: Jul. 11, 2000

[54] TRIGGERED SPRING EJECTABLE BLADE SHEATHED KNIVES

[76] Inventor: Anthony L. Marifone, 932 36th Ct. SW., Vero Beach, Fla. 32962

[21] Appl. No.: 09/272,486

[22] Filed: Mar. 19, 1999

[51] Int. Cl.[7] ..... B26B 1/08

[52] U.S. Cl. ..... 30/162; 30/335; 30/151

[58] Field of Search ..... 30/162, 163, 151, 30/335

[56] References Cited

U.S. PATENT DOCUMENTS

| | | | |
|---|---|---|---|
| 845,792 | 3/1907 | Jenkins | 30/162 |
| 1,813,723 | 7/1931 | Beaver | 30/162 |
| 2,854,745 | 10/1958 | Braverman | 30/162 |
| 3,106,017 | 10/1963 | Milbrandt | 30/162 |

FOREIGN PATENT DOCUMENTS

| | | | |
|---|---|---|---|
| 102546 | 7/1898 | Germany | 30/162 |
| 2169539 | 7/1986 | United Kingdom | 30/162 |

*Primary Examiner*—Hwei-Siu Payer
*Attorney, Agent, or Firm*—Carroll F. Palmer

[57] ABSTRACT

Sheathed knives are disclosed that have a blade that is ejected via a button triggered spring longitudinally from the sheath into a locked use position in which the sheath then serves as the handle for the blade in the nature of a dagger, an elongated handled rod that slides within the sheath to draw the blade from its use position back into the sheath where it is automatically locked in a spring loaded sheathed position for triggered release into its use position and safety features to prevent the blade from accidental movement in or out relative to the sheath.

3 Claims, 4 Drawing Sheets

TRIGGERED SPRING EJECTABLE BLADE SHEATHED KNIVES

BACKGROUND OF THE INVENTION

1. Field of the Invention

This application relates to triggered, spring ejectable blade, sheathed knives. More particularly, it concerns sheathed knives having a single blade that is ejected by a triggered spring longitudinally from the sheath which then serves as the handle for the blade.

2. Description of the Prior Art

The most common type of sheathed knives are the so-called "pocket knives" in which a blade is pivoted at one end to move between a sheathed position and a use position, e.g., see U.S. Pat. Nos. 3,783,509, 3,829,967, 4,040,181 and 5,502,895.

Another type are sheathed knives in which the knife blade is stored in a separable sheath, usually structured for attachment to the waist belt of the user, from which the entire knife is withdrawn for use, e.g., see U.S. Pat. Nos. 5,138,768, 5,255,436 and 5,297,341.

A third type are sheathed knives in which the blade and sheath move longitudinally relative to each other to fix the blade alternatively in a sheathed position or a use position with the sheath serving as the handle for the blade. Such knives come in two basic forms, namely, (1) utility knives having replaceable blades short in length relative to the handle, e.g., see U.S. Pat. Nos. 4,091,537 and 4,337,576, and (2) permanent blade knives in which the blade is of length about equal to the sheath, e.g., see U.S. Pat. Nos. 4,523,379 and 4,823,463.

The new knives disclosed herein are of the third type, permanent blade form.

OBJECTS

A principal object of the invention is the provision of unique sheathed knives having a single blade that is ejected by a triggered spring longitudinally from the sheath which then serves as the handle for the blade.

Another object of the invention is the provision of a unique form of retractable, permanent blade, sheathed knives wherein the blade is moved by a triggered spring longitudinally of the sheath from a sheathed position to an extended use position in the nature of a dagger and is returned to the sheathed position by a sliding, handled rod which cocks the spring while retracting the blade.

A further object is the provision in such unique knives of special safety features to avoid accidental movement of the blade relative to the sheath.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of a retractable, permanent blade sheathed knife wherein the blade is moved by a triggered spring longitudinally of the sheath from a sheathed position to an extended use position and is returned to the sheathed position by a sliding handle which cocks the spring while retracting the blade into the sheath.

The knives of the invention comprise an elongated double edged blade defined by a pointed blade front end, a blade rear end of blade width prescribed by longitudinal blade edges and a notch therein positioned between the front end and the rear end.

An L-shaped buttress is integrally joined to the blade rear end. This is defined by a buttress front end having a width of about equal to the blade width, a buttress rear end of width less than the blade width, a long straight side extending from the buttress front end to the buttress rear end and a gapped side having a long inside portion and short outside portion. The gapped side defines a rectangular recess in the buttress creating its L-shape.

The sheaths of the new knives comprise a front sheath member and a rear sheath member fastened together with their inner surfaces face to face forming a cavity in which the blade reciprocates between the sheathed position and the use position.

The elongated front sheath member is defined by a first blade end, a first opposite end, a pair of first contoured sides, an essentially planar first external surface, a contoured first internal surface and a central bore therethrough.

The elongated back sheath member is defined by a second blade end, a second opposite end, a pair of second contoured sides, an essentially planar second external surface and a contoured second internal surface.

The cavity formed by the front and back sheath members contains an elongate handled rod that slides longitudinally in a groove within the back sheath member operatively coupled to the blade to retract the blade from the use position to the sheathed position.

A trigger button is reciprocally carried in said central bore and operatively connected to said coil spring to release said coil spring from said cocked condition upon depression thereof.

The retractable, permanent blade sheathed knife of the invention further comprise a sliding safety, a lock bar and a leaf lock that serve to avoid accidental movement of the blade relative to the sheath.

BRIEF DESCRIPTION OF THE DRAWINGS

A more complete understanding of the invention can be obtained by reference to the accompanying drawings in which generic parts of the illustrated matter are indicated by arrowhead lines associated with the designation numerals while specific parts are indicated with plain lines associated with the numerals and wherein.

DESCRIPTION OF THE PREFERRED EMBODIMENTS

Figure 1:
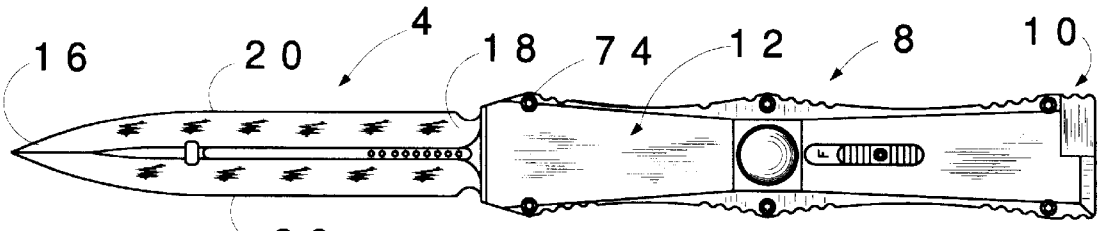
FIG. 1 is front plan view of a sheathed knife constructed in accordance with the invention having its blade fulled extended into its use position.
Figure 3:
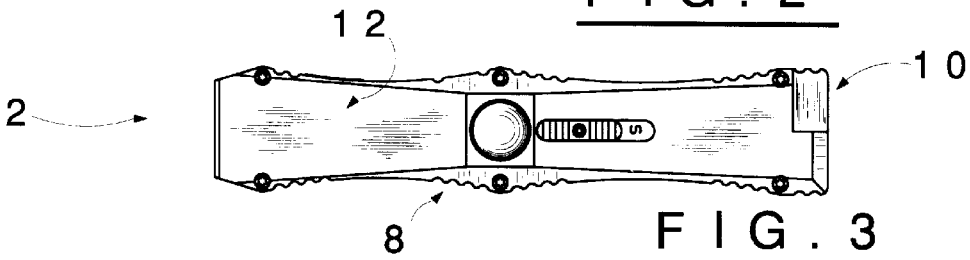
FIG. 3 is a view like FIG. 1 with the knife blade fully withdrawn into the sheath and locked in that position.
Figure 4:
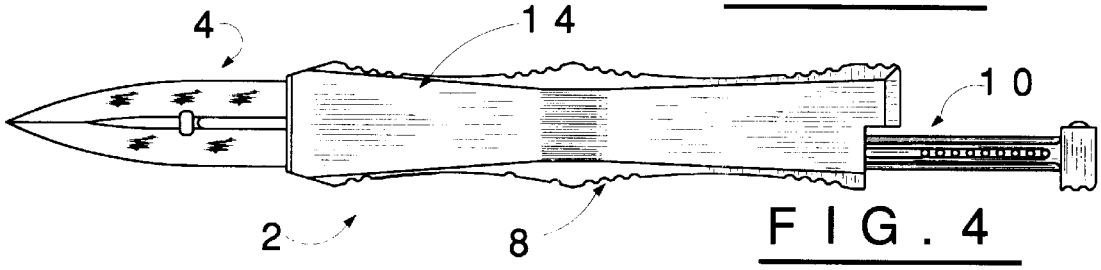
FIG. 4 is a back plan view of the knife as shown in FIG. 2.

With reference in detail to the drawings, a sheathed knife 2 of the invention comprises a retractable, permanent blade 4 which is moved by a triggered spring 6 longitudinally of the sheath 8 from a sheathed position, shown in FIG. 3, to an extended use position, shown in FIG. 1.

The blade 4 is returned from the use position to the sheathed position by a sliding handled rod 10 which cocks the spring 6 while retracting the blade 4 into the sheath 8, which comprises a front member 12 and a rear member 14.

Figure 11:
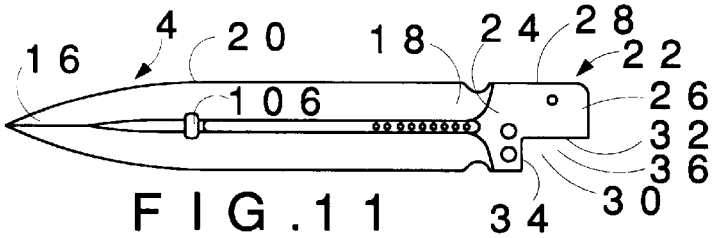
FIG. 11 is a plan view of the blade of the knife shown in FIG. 1.

With reference to FIG. 11, the elongated double edged blade 4 is defined by a pointed front end 16 and a rear end 18 having a blade width prescribed by longitudinal blade edges 20.

An L-shaped buttress 22 has a buttress front end 24 of about said blade width integrally joined to blade rear end 18, a buttress rear end 26 of width less than said blade width, a long straight side 28 extending from said buttress front end 24 to said buttress rear end 26 and a gapped side 30 having a long inside portion 32 and short outside portion 34. The gapped side 30 defines a rectangular recess 36 in buttress 22 creating its L-shape.

Figure 13:
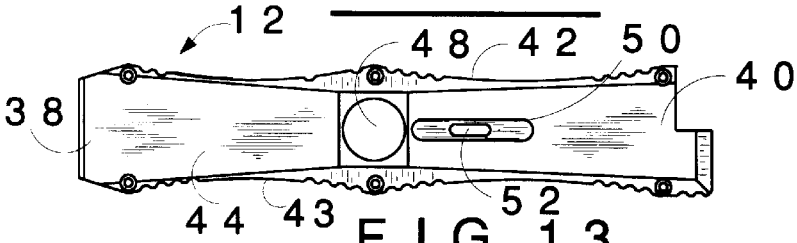
FIG. 13 is a plan view of outside of the front plate of the knife sheath.
Figure 14:
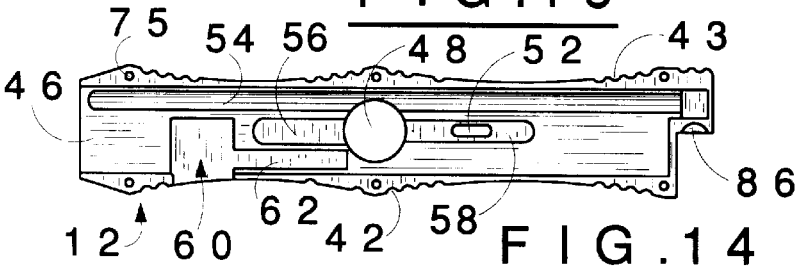
FIG. 14 is a plan view of the inside of the front plate of the knife sheath.

With reference to FIGS. 13 & 14, the front member 12 of sheath 8 has a first blade end 38, a first opposite end 40, a pair of first contoured sides 42 & 43, a first external surface 44 and a contoured first internal surface 46. A bore 48 extends centrally through member 12, external surface 44 contains an elongated first furrow 50 and a slot 52 extends through the base of furrow 50.

The front member 12 internal surface 46 contains an elongated groove 54, a second furrow 56 that communicates at one end with bore 48, a third furrow 58 that communicates at one end with bore 48 and surrounds slot 52. Internal surface 46 also contains a contoured cavity 60 that exits at one side through the member side 42 and includes an integral longitudinal leg 62.

Figure 5:
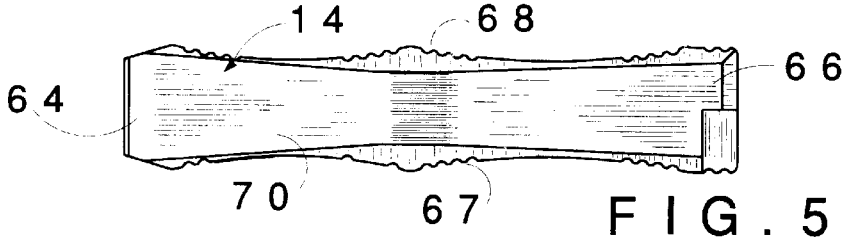
FIG. 5 is a back plan view of the knife as shown in FIG. 3.
Figure 12:
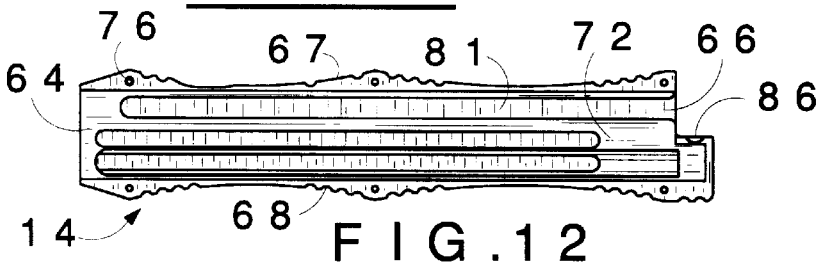
FIG. 12 is a plan view of the inside of the back plate of the knife sheath.

With reference to FIGS. 5 & 12, the back member 14 has a blade end 64, an opposite end 66, a pair of contoured sides 67 & 68, an essentially planar external surface 70 and a contoured internal surface 72.

Internal surface 46 of member 12 and internal surface 72 of member 14 are fastened together face to face by screws 74 which insert through bores 75 in member 12 to thread into threaded bores 76 in member 14 thereby forming a cavity 78 in which blade 4 reciprocates between sheathed position of FIG. 3 and use position of FIG. 1.

Figure 2:
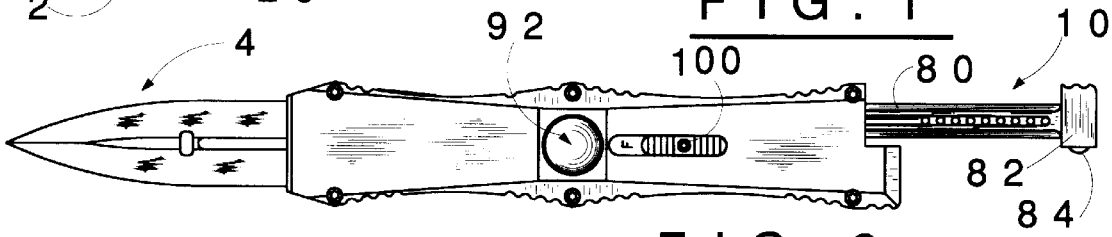
FIG. 2 is a view like FIG. 1 with the knife blade partially withdrawn into the sheath.
Figure 17:
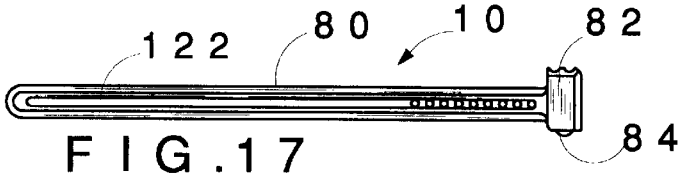
FIG. 17 is a plan view of the sliding, handled rod of the knife shown in FIG. 7.
Figure 27:
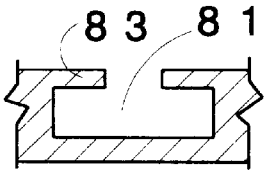
FIG. 27 is a fragmentary sectional view of the channel in the back plate of the sheath in which the sliding handled rod of the knife slides.

With reference to FIGS. 2, 12 & 17, the sliding handled rod 10 comprises an elongate rod 80 that slides longitudinally in the groove 81 of rectangular cross-section as shown in FIG. 27 with longitudinal ledges 83 along the open side. Rod 80 has a cross-section to compliment the cross-section of groove 81 and a handle end 82 which has a nib 84 to nest with dimple 86 in members 12 & 14 to retain rod 80 in its closed position as shown in FIG. 1. The nib 84 may be a molded part of the handle end 82 or a spring biased retained ball (not shown).

Figure 6:
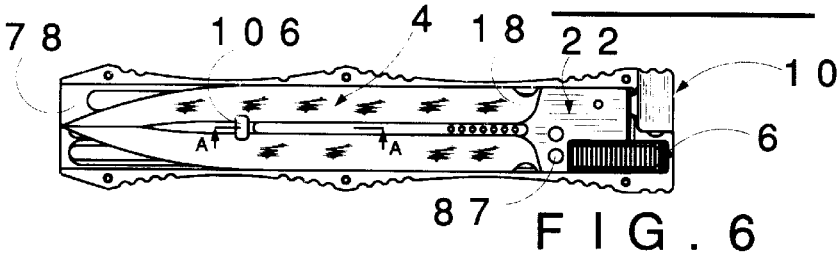
FIG. 6 is like FIG. 3, but with the front plate of the knife sheath removed.
Figure 7:
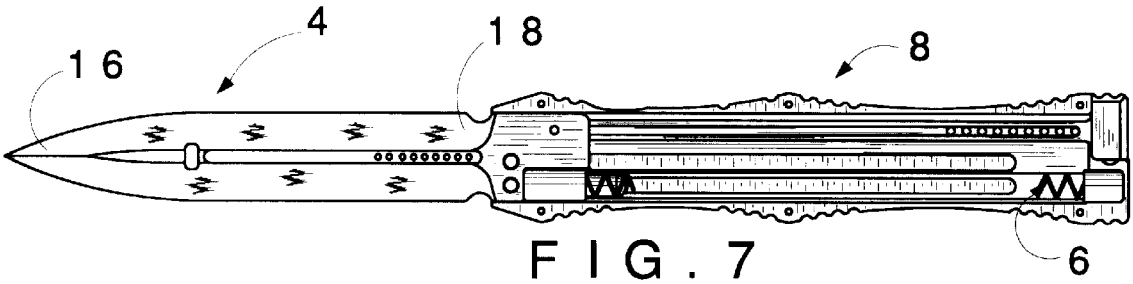
FIG. 7 is like FIG. 1, but with the front plate of the knite sheath removed.
Figure 18:
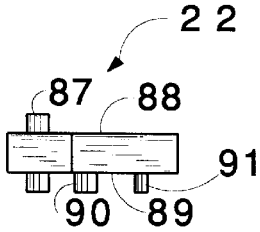
FIG. 18 is a longitudinal buttress end view of the knife blade shown in FIG. 11.

With reference to FIGS. 6, 11 & 18, the buttress 22 comprises a first pin 87 that extends laterally from both surfaces 88 & 89 plus second and third pins 90 & 91 that extend only from surface 89. The pins 87, 90 & 91 are press fitted into bores (unnumbered) in buttress 22.

Figure 21:
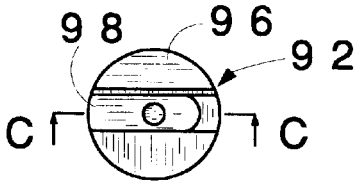
FIG. 21 is an obverse view of the trigger button of the new knives.
Figure 22:
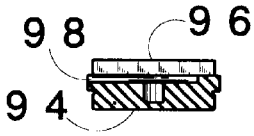
FIG. 22 is a sectional view taken on the line C—C of FIG. 21.

With reference to FIGS. 21 & 22, the trigger button 92 has a finger contact surface 94 and a contoured undersurface 96 containing a slot 98. Button 92 is depressed by the user of the knife 2 to release the blade 4 for movement from the sheathed position (FIG. 3) to the use position (FIG. 1).

Figure 15:
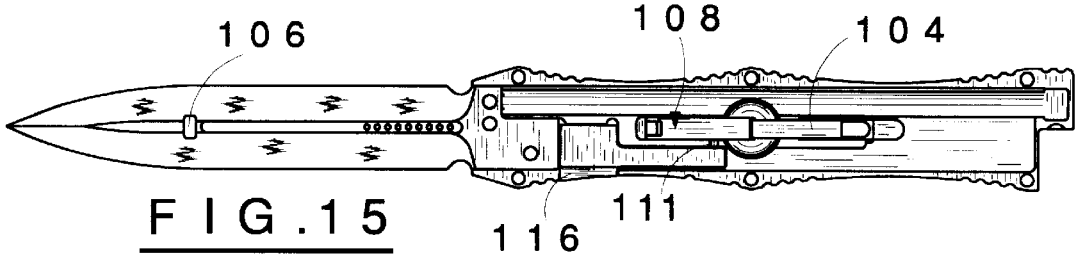
FIG. 15 is similar to FIG. 4, but with the back plate of the knife sheath removed.
Figure 16:
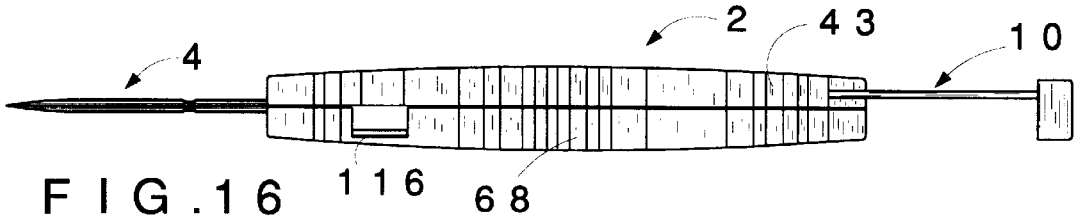
FIG. 16 is a lateral view of the knife as shown in FIG. 4.
Figure 19:
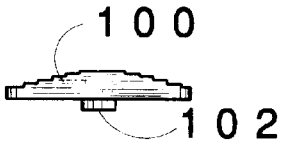
FIG. 19 is a lateral view of the sliding safety of the new knives.
Figure 20:
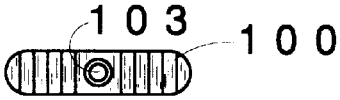
FIG. 20 is a plan view of the sliding safety.
Figure 24:
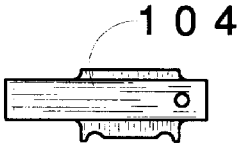
FIG. 24 is a plan view of the lock bar of the new knives.

With reference to FIGS. 19 & 20, the sliding safety 100 slides along the furrow 50 between a safe position (FIG. 1) and a free position (FIG. 2) while its nib 102 slides in the slot 52. Safety 100 is fixed via a fastener (not shown) that extends through bore 103 and connects safety 100 to lock bar 104 (FIG. 24) which, in turn, slides in furrow 58 (FIGS. 14 & 15) and, also, in and out of slot 98 in button 92. When lock bar 104 is in slot 98 (FIG. 15), the button 92 can not be depressed so the knife 2 is "on safety". When safety 100 is moved into the free position (FIG. 2), the lock bar 104 is withdrawn from the slot 98 so the button 92 may be depressed to trigger the blade 4 to spring into the use position (FIG. 1).

Figure 8:
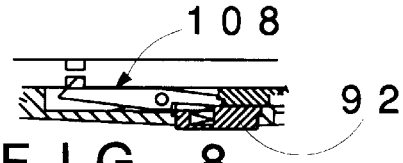
FIG. 8 is a fragmented, sectional view taken on the line A—A of FIG. 6.
Figure 9:
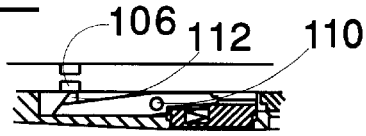
FIG. 9 is like FIG. 8, but with the knife's trigger bottom depressed to release the blade from the sheath into the use position as shown in FIG. 1.
Figure 10:
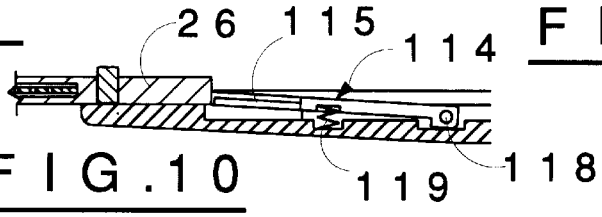
FIG. 10 is a fragmented, sectional view taken on the line A—A of FIG. 6 just as the trigger button is depressed.
Figure 23:
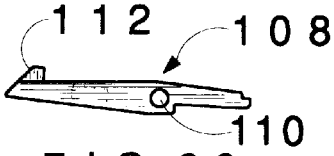
FIG. 23 is lateral view of the blade catch of the new knives.

The blade 4 contains a notch 106 which functions with the blade catch 108 (FIG. 23) to lock the blade in the sheathed position and release it to move into the use position. The catch 108 has a bore 110 that receives a pin 111 (FIG. 15) to hold catch 108 tiltably in slot 56 of member 12 (FIG. 14). When the blade 4 is pulled back into the sheath 8 by the handled rod 10 while the spring 6 is compressed, the hook 112 of catch 108 engages the notch 106 to retain the blade in the sheath 8 (FIG. 8). Depression of the button 92 moves the hook 112 out of the notch 106 (FIG. 9) whereby the spring ejects the blade 4 from the sheath 8 into the use position (FIGS. 1 & 10).

Figure 25:
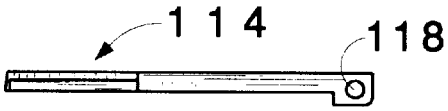
FIG. 25 is a lateral view of the leaf lock of the new knives.
Figure 26:
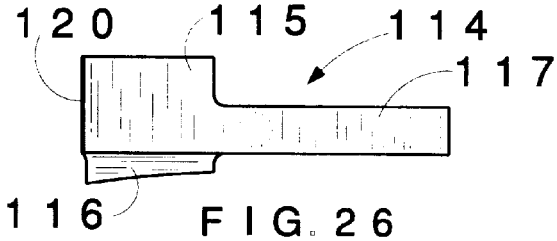
FIG. 26 is a plan view of the leaf lock.

With reference to FIGS. 25, 26 & 14, the leaf lock 114 comprises a base 115, a side ledge 116 and a leg 117 with a through bore 118 in its end. The leaf lock 114 is housed in the cavity 60, is pivoted therein by a pin (not shown) though bore 118 and is biased by spring 119 to move edge 120 to engage end 26 of buttress 22 (FIG. 10) to lock the blade in its use position immediately upon full extension of the blade 4 from sheath 8.

When the blade is to be returned to its sheathed position, the side ledge 116 of leaf lock 114 is pressed by a finger of the user of the knife 2 to disengage the edge 120 from the end 26 of buttress 22. This enables the handled rod 10 to retract the blade 4 into the sheath 8 by pulling back on the pin 91 which rides in the groove 122 of the handle 10. When the handle 10 reaches full extension from the sheath 8, the notch 106 of the blade 4 again engages the hook 112 of blade catch 108 whereby the blade 4/spring 6 combination is recocked for another discharge of the blade 4 triggered by pressing of button 92.

The above detailed discussion of the unique knives 2 of the invention show that the sliding safety 100, lock bar 104 and leaf lock 114 comprise special safety features that serve to avoid accidental movement of the blade relative to the sheath. Thus, the combination of these components serves to keep the blade locked in the sheath when that is intended and to retain the blade in the use position when that is the intended mode. Accordingly, an owner of such unique knife can safely carry it upon his/her person without fear of injury by accidental release of the blade from the sheath. At the same time, the owner is assured of instantaneous release of the blade from the sheath into the use position by movement of the safety into the free position and pressing of the trigger button. Further, the owner is assured that immediately upon full discharge of the blade into the use position, the blade will be securely locked in its use position for as long as the knife owner chooses. Finally, upon completion of use of the knife, the owner can easily return the blade into the sheath by depressing the ledge 116 of the leaf lock while simultaneously pulling out the handled rod 10.

What is claimed is:

1. A retractable, permanent blade sheathed knife wherein an elongated blade is moved by a coil spring longitudinally of a sheath from a sheathed position to an extended use position and is returned to the sheathed position by a sliding handle which moves said coil spring into a cocked position while retracting said blade into said sheath, said knife comprising:

said elongated blade that is defined by a pointed blade front end, a blade rear end of blade width prescribed by longitudinal blade edges and a notch therein positioned between said front end and said rear end, an L-shaped buttress defined by a buttress front end of about said blade width integrally joined to said blade rear end, a buttress rear end of width less than said blade width, a long straight side extending from said buttress front end to said buttress rear end and a gapped side having a long inside portion and a short outside portion, said gapped side defining a rectangular recess in said buttress creating its L-shape, an elongated front sheath member defined by a first blade end, a first opposite end, a pair of first contoured sides, an essentially planar first external surface, a contoured first internal surface and a central bore therethrough, an elongated back sheath member defined by a second blade end, a second opposite end, a pair of second contoured sides, an essentially planar second external surface and a contoured second internal surface, said first and second internal surfaces being fastened together forming in said sheath a cavity in which said elongated blade reciprocates between said sheathed position and said use position, said sliding handle comprising an elongate rod that slides longitudinally in a groove within said back sheath member operatively coupled to said blade to retract said elongated blade from said use position to said sheathed position, and a trigger button reciprocally carried in said central bore and operatively connected to said coil spring to release said coil spring from said cocked position upon depression thereof.

2. The retractable, permanent blade sheathed knife of claim 1 comprising a sliding safety, a lock bar and a leaf lock that serve to avoid accidental movement of the blade relative to said sheath.

3. A retractable, permanent blade sheathed knife comprising:

a two part sheath defining a cavity therein, a blade that is moved by a coil spring longitudinally of said sheath from a sheathed position within said cavity to an extended use position external of said sheath, a sliding handle that reciprocates in said sheath to return said blade to said sheathed position from said extended use position and cock said coil spring while retracting said blade into said cavity, said sliding handle comprising an elongated rod that slides within the sheath to draw the blade from its use position back into said cavity where it is automatically locked in a spring loaded sheathed position for triggered release into said use position, a trigger button that reciprocates in said sheath to release said blade from said spring loaded sheathed position, and a sliding safety, a lock bar and a leaf lock that serve to avoid accidental movement of the blade relative to said sheath.

* * * * *